US007956880B2

(12) United States Patent
Shoji et al.

(10) Patent No.: US 7,956,880 B2
(45) Date of Patent: Jun. 7, 2011

(54) HEATING RESISTOR ELEMENT COMPONENT, THERMAL PRINTER, AND MANUFACTURING METHOD FOR A HEATING RESISTOR ELEMENT COMPONENT

(75) Inventors: Noriyoshi Shoji, Chiba (JP); Norimitsu Sanbongi, Chiba (JP); Yoshinori Sato, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 74 days.

(21) Appl. No.: 12/381,702

(22) Filed: Mar. 16, 2009

(65) Prior Publication Data

US 2009/0231408 A1 Sep. 17, 2009

(30) Foreign Application Priority Data

Mar. 17, 2008 (JP) ..... 2008-067942

(51) Int. Cl.
*B41J 2/335* (2006.01)

(52) U.S. Cl. ..... 347/202; 347/205

(58) Field of Classification Search ..... 347/200, 347/202, 205

See application file for complete search history.

(56) References Cited

U.S. PATENT DOCUMENTS 5,357,271 A * 10/1994 Wiklof et al. ..... 347/197
5,940,109 A * 8/1999 Taniguchi et al. ..... 347/205
7,522,178 B2 * 4/2009 Shoji et al. ..... 347/205

FOREIGN PATENT DOCUMENTS

JP 2007-083532 * 4/2007

* cited by examiner

*Primary Examiner* — Huan H Tran
(74) *Attorney, Agent, or Firm* — Adams & Wilks

(57) ABSTRACT

A heating resistor element component has supporting substrate with a concave portion formed in a surface of the supporting substrate. A glass substrate is disposed on the surface of the supporting substrate. At least a region of the glass substrate opposite to the concave portion of the support substrate has a heterogeneous phase structure with physical properties different from those of the material of the glass substrate such that an overall mechanical strength of the glass substrate is increased. The heterogeneous phase structure is formed by laser processing using a phemtosecond laser having a power intensity of $1\times10^6$ W to $1\times10^8$ W. Heating resistors are arranged at intervals on the glass substrate and have heating portions disposed opposite to the concave portion of the supporting substrate. A common wire is connected to one end of each of the heating resistors. Individual wires are each connected to another end of each of the heating resistors.

16 Claims, 5 Drawing Sheets

HEATING RESISTOR ELEMENT COMPONENT, THERMAL PRINTER, AND MANUFACTURING METHOD FOR A HEATING RESISTOR ELEMENT COMPONENT

BACKGROUND OF THE INVENTION

1. Field of the Invention

The present invention relates to a heating resistor element component (thermal head) which is used in a thermal printer typically mounted onto a compact information equipment terminal such as a compact handy terminal, and is used for performing printing on a thermal recording medium through selective driving of a plurality of heating elements based on print data.

2. Description of the Related Art

Recently, thermal printers have been widely used in compact information equipment terminals. The compact information equipment terminals are driven by a battery, which leads to strong demands for electric power saving of the thermal printers. Accordingly, there have been growing demands for heating resistor element components having high heating efficiency.

As to increasing efficiency of the thermal head, there is known a method of forming a hollow portion in a lower layer of a heating resistor (for example, see JP 2007-83532 A). Among an amount of heat generated in the heating resistor, an amount of upper-transferred heat which is transferred to a wear-resistant layer formed above the heating resistor becomes larger than an amount of lower-transferred heat which is transferred to a supporting substrate located under the heating resistor, and thus energy efficiency required during the printing can be sufficiently obtained.

However, in the heating resistor element component disclosed in JP 2007-83532 A, a heat accumulating layer (insulating film) provided on a surface of the supporting substrate is required to have a thickness to some extent in terms of a mechanical strength, which imposes a limitation on reducing a thickness (size in a height direction) of the heating resistor element component.

SUMMARY OF THE INVENTION

The present invention has been made in view of the above-mentioned circumstances, and therefore an object thereof is to provide a heating resistor element component capable of reducing a plate thickness of an insulating film, and a thermal printer.

In order to solve the aforementioned problems, the present invention employs the following means.

A heating resistor element component according to the present invention includes: a supporting substrate; an insulating film disposed on a surface of the supporting substrate; a plurality of heating resistors arranged at intervals on the insulating film; a common wire connected to one end of each of the plurality of heating resistors; and individual wires each connected to another end of each of the plurality of heating resistors, in which: the surface of the supporting substrate is provided with a concave portion in a region thereof, the region being opposed to heating portions of the plurality of heating resistors; and when the insulating film is superimposed on the supporting substrate, the insulating film includes a heterogeneous phase formed through irradiation of a phemtosecond laser at least in a region thereof, the region being opposed to the concave portion.

Another heating resistor element component according to the present invention includes: a supporting substrate; an insulating film disposed on a surface of the supporting substrate; a plurality of heating resistors arranged at intervals on the insulating film; a common wire connected to one end of each of the plurality of heating resistors; and individual wires each connected to another end of each of the plurality of heating resistors, in which: a rear surface of the insulating film opposed to the supporting substrate is provided with a concave portion in a region thereof, the region being opposed to heating portions of the plurality of heating resistors; and the insulating film includes a heterogeneous phase formed through irradiation of a phemtosecond laser at least in a region thereof, the region corresponding to the concave portion.

According to the heating resistor element component of the present invention, the heterogeneous phase for improving a mechanical strength is formed, for example, in a region (that is, region of the insulating film, which is opposed to the each concave portions of the insulating film) to which a bending stress is applied when the heating resistor element component is set in a thermal printer to be pressed against a thermal paper by a pressure mechanism with a predetermined pressing force, with the result that the plate thickness of the insulating film can be further reduced when compared with those in the conventional cases (for example, can be made smaller than 10 μm).

Further, a concave-convex portion is formed on (extends to) a surface of a protective film formed (laminated) on the insulating film, and thus surface roughness of the protective film can be increased, whereby the pressing force against the thermal paper can be locally increased. Accordingly, thermal transfer efficiency can be improved.

Further, the concave-convex portion formed on the surface of the protective film reduces a contact area between the heating resistor element component and the thermal paper, whereby a sticking phenomenon (phenomenon in which a part of a coupler or a developer melted during printing sticks and adheres, when energy is cut off, to the thermal heads so as to cause poor transportation) can be prevented (reduced).

In the above-mentioned heating resistor element component, more preferably, the convex portion is provided in common to the plurality of heating resistors.

According to the heating resistor element component as described above, the adjacent concave portions are made to be in communication with each other, and a part of a flowing path of heat (amount of heat) generated in the heating resistors into the supporting substrate is cut off, whereby the heat (amount of heat) generated in the heating resistors can be further prevented from flowing into the supporting substrate. As a result, heating efficiency of the heating resistors can be further increased, which leads to an additional reduction in power consumption.

A thermal printer according to the present invention includes the heating resistor element component with which the heating efficiency of the heating resistors can be improved to reduce power consumption, and thus printing on thermal paper can be performed with less electric power, with the result that the battery life can be extended, and reliability of the entire thermal printer can be increased.

According to the present invention, a manufacturing method for a heating resistor element component includes: processing a concave portion which forms a hollow portion on a surface of a supporting substrate; forming, when an insulating film is superimposed on the supporting substrate, a heterogeneous phase through irradiation of a femtosecond laser at least in a region of the insulating film, the region being opposed to the concave portion; and superimposing the insulating film on the supporting substrate to bond the supporting substrate and the insulating film to each other.

According to the present invention, another manufacturing method for a heating resistor element component includes: processing a concave portion which forms a hollow portion on a rear surface of an insulating film; forming a heterogeneous phase through irradiation of a phemtosecond laser at least in a region of the insulating film, the region corresponding to the concave portion; and superimposing the insulating film on the supporting substrate to bond the supporting substrate and the insulating film to each other.

According to the manufacturing method for a heating resistor element component of the present invention, the heterogeneous phase for improving a mechanical strength is formed, for example, in a region (that is, region of the insulating film, which is opposed to the concave portions of the insulating film) to which a bending stress is applied when the heating resistor element component is set in a thermal printer to be pressed against a thermal paper by a pressure mechanism with a predetermined pressing force, with the result that the plate thickness of the insulating film can be further reduced when compared with those in the conventional cases (for example, can be made smaller than 10 μm) and the entire thickness (size in a height direction) of the heating resistor element component can be reduced.

Further, a concave-convex portion is also formed on (extends to) a surface of a protective film formed (laminated) on the insulating film, and thus surface roughness of the protective film can be increased, whereby the pressing force against the thermal paper can be locally increased. Accordingly, thermal transfer efficiency can be improved.

Further, the concave-convex portion formed on the surface of the protective film reduces a contact area between the heating resistor element component and the thermal paper, whereby a sticking phenomenon (phenomenon in which a part of a coupler or a developer melted during printing sticks and adheres, when energy is cut off, to the thermal head so as to cause poor transportation) can be prevented (reduced).

According to the present invention, there is attained an effect that the plate thickness of the insulating film can be reduced.

DETAILED DESCRIPTION OF THE PREFERRED EMBODIMENTS

Hereinafter, a heating resistor element component according to a first embodiment of the present invention is described with reference to FIG. 1 to FIGS. 3A to 3C.

Figure 1:
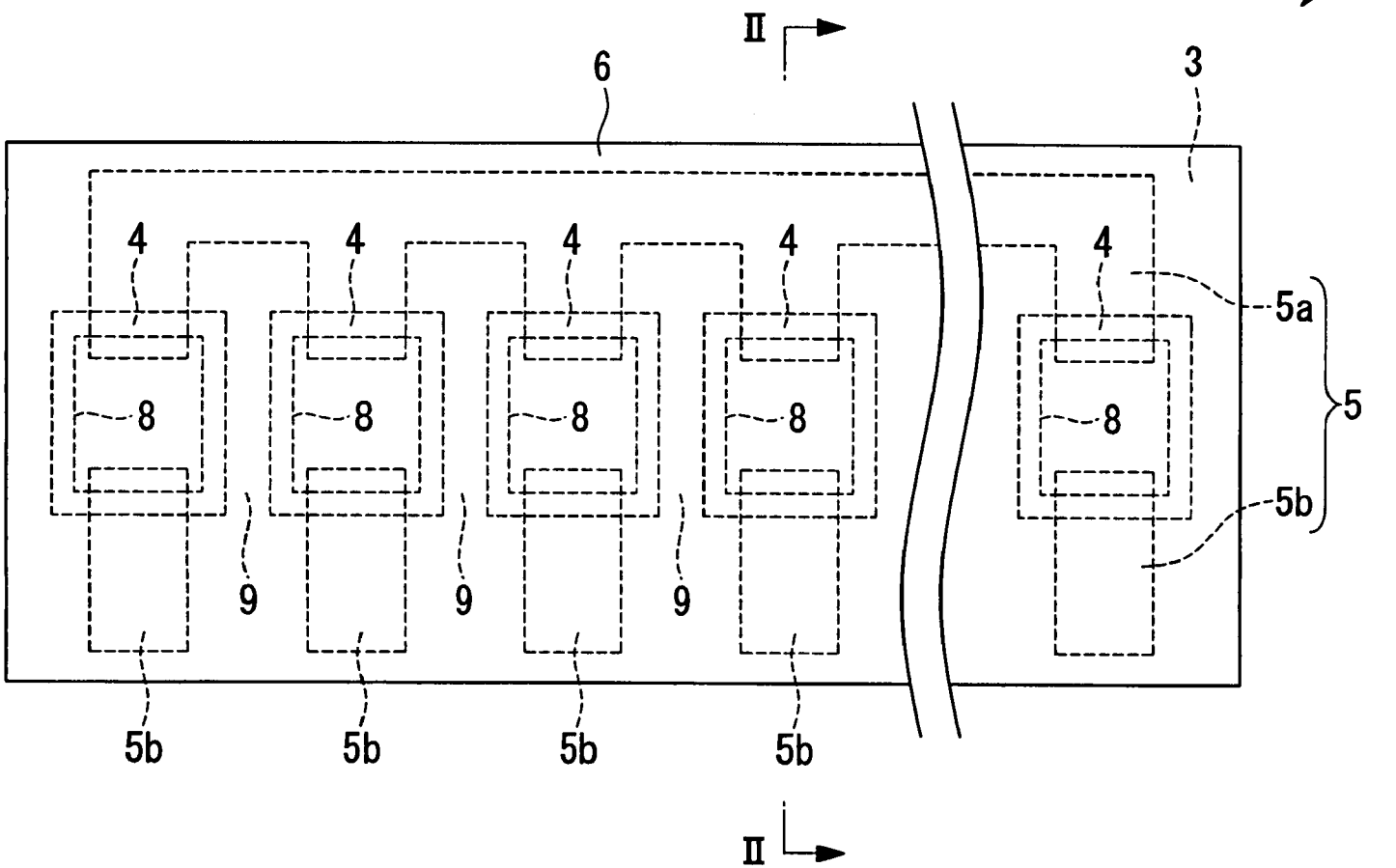
FIG. 1 is a plan view of a thermal head serving as a heating resistor element component according to a first embodiment of the present invention.
Figure 2:
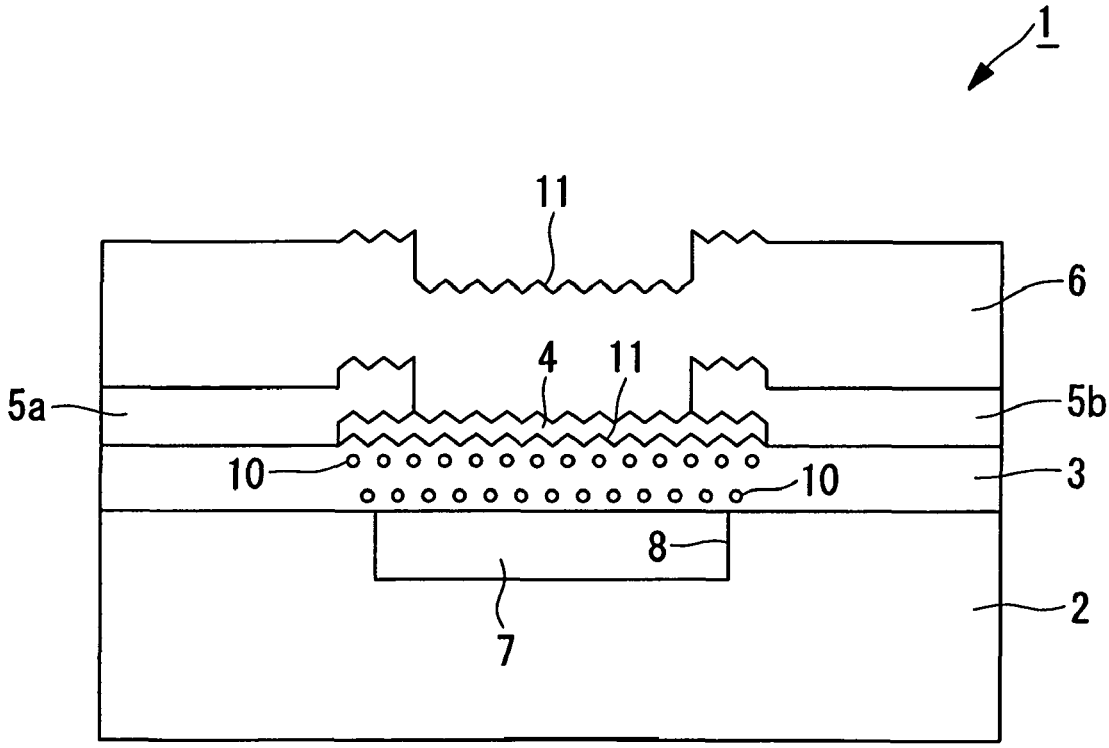
FIG. 2 is a view taken along the arrow II-II of FIG. 1.

FIG. 1 is a plan view of a thermal head serving as a heating resistor element component according to this embodiment, FIG. 2 is a view taken along the arrow II-II of FIG. 1, and FIGS. 3A to 3C are process drawings for describing a manufacturing method for the thermal head serving as the heating resistor element component according to this embodiment, which are similar to FIG. 2.

A heating resistor element component 1 according to this embodiment is a thermal head (hereinafter, referred to as "thermal head") used in a thermal printer.

As illustrated in FIG. 2, the thermal head 1 includes a supporting substrate (hereinafter, referred to as "substrate") 2 and an undercoat (insulating film) 3 formed on the substrate 2. In addition, as illustrated in FIG. 1 and FIG. 2, a plurality of heating resistors 4 are formed (arranged) at intervals in one direction on the undercoat 3, and wiring 5 is connected to the heating resistors 4. The wiring 5 is formed of a common wire 5*a* connected to one end of each of the heating resistors 4 in a direction perpendicular to an arrangement direction thereof (hereinafter, referred to as "object-to-be-printed feeding direction") and individual wires 5*b* connected to another end thereof. Further, as illustrated in FIG. 2, the thermal head 1 includes a protective film 6 which covers top surfaces of the heating resistors 4 and a top surface of the wiring 5.

It should be noted that a portion (hereinafter, referred to as "heating portion") in which the heating resistor 4 actually generates heat is a portion which does not overlap the wiring 5.

As illustrated in FIG. 2, on a surface (upper surface in FIG. 2) of the substrate 2, there is formed a concave portion 8 which forms a hollow portion (void heat insulating layer) 7.

The concave portion 8 is provided to form the hollow portion (void heat insulating layer) 7 for each heating resistor 4, and adjacent concave portions 8 are separated (partitioned) from each other by an inter-dot barrier 9. A space formed (enclosed) with a bottom surface (surface parallel to the surface of the substrate 2) and wall surfaces (surfaces perpendicular to the surface of the substrate 2) of the concave portion 8 and a rear surface (lower surface in FIG. 2) of the undercoat 3 forms the hollow portion 7.

Through the formation of the plurality of concave portions 8 on the surface of the substrate 2, an entire surface (upper surface in FIG. 2) of the inter-dot barrier 9 located between the adjacent concave portions 8 abuts on the rear surface of the undercoat 3. In other words, the adjacent concave portions 8 are sectioned (partitioned) by the inter-dot barrier 9.

Figure 3A:
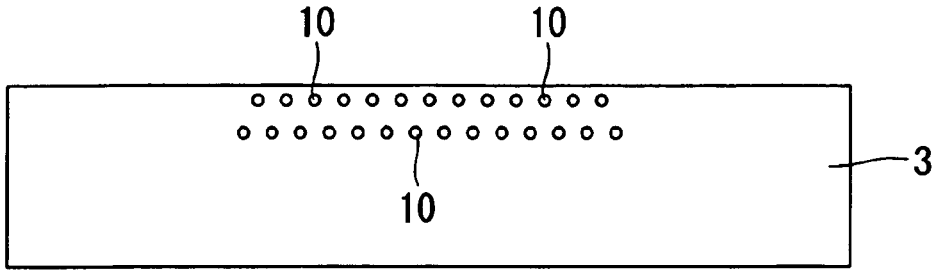
FIGS. 3A to 3C are process drawings for describing a manufacturing method for the thermal head serving as the heating resistor element component according to the first embodiment of the present invention, which are similar to FIG. 2.
Figure 3B:
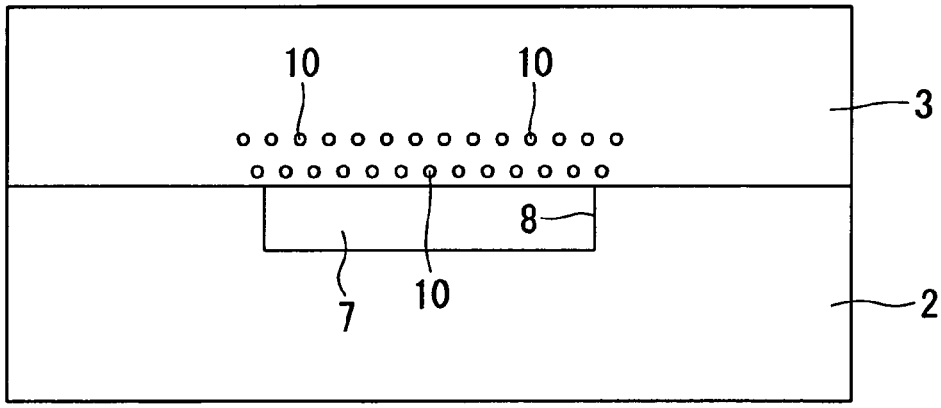
Figure 3C:
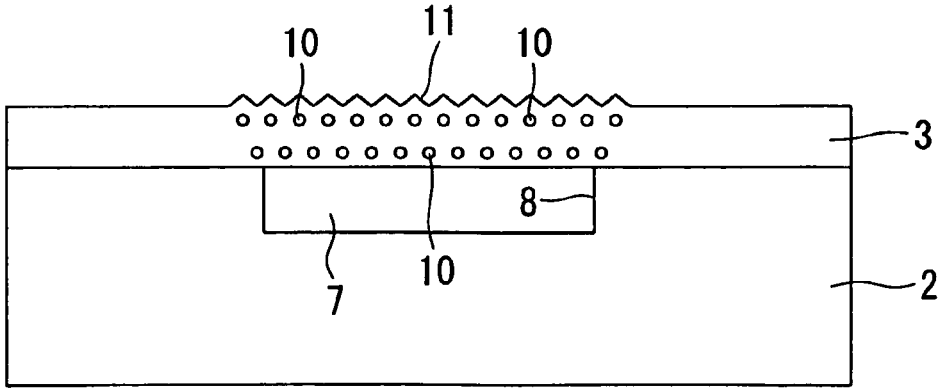

Next, with reference to FIG. 3A to FIG. 3C, a manufacturing method for the thermal head 1 according to this embodiment is described.

First, as illustrated in FIG. 3A, a femtosecond laser (ultrashort pulse laser having high focused intensity of $1\times10^{6}$ W to $1\times10^{8}$ W ($1\times10^{-14}$ sec to $1\times10^{-12}$ sec)) is irradiated from the surface (upper surface in FIG. 3A) of the undercoat 3 having a uniform thickness, and a heterogeneous phase (phase having physical properties different from those of a base material (in this case, undercoat 3)) 10 is formed in a region (and a boundary region thereof) which is located on the surface of the undercoat 3 and is opposed to the respective concave portions 8 when the undercoat 3 is superimposed on the substrate 2.

In this embodiment, an irradiation pitch is set to 0.5 μm to 20 μm, and the femtosecond laser is adjusted so that the heterogeneous phase 10 is formed in a position located 1 μm to 30 μm below from the surface of the undercoat 3.

Next, for every region on the surface of the substrate 2 having a uniform thickness, where the heating resistors 4 are formed, the concave portion 8 which forms the hollow portion 7 is processed. As a material of the substrate 2, for example, a glass substrate or a single-crystal silicon substrate is used. A thickness of the substrate 2 is about 300 μm to 1 mm.

The concave portion 8 is formed on the surface of the substrate 2 by sandblasting, dry etching, wet etching, laser processing, or the like.

In the case where the substrate 2 is processed by sandblasting, the surface of the substrate 2 is covered with a photoresist material, and the photoresist material is exposed to light using a photo mask having a predetermined pattern, thereby solidifying a portion other than a region in which the concave portions 8 are formed. Then, the photoresist material which is not solidified by development is removed, whereby an etching window is obtained in the region where the concave portion 8 is formed. The surface of the substrate 2 is subjected to sandblasting in this state, and thus the concave portion 8 having the predetermined depth is obtained.

In the case where processing is performed through etching, an etching mask having an etching window formed in the region where the concave portion 8 is formed is formed on the surface of the substrate 2 in the same manner, and the surface of the substrate 2 is subjected to etching in this state, whereby the concave portion 8 having the predetermined depth is obtained. In the etching process, for example, wet etching is performed using an etching liquid such as a tetramethylammonium hydroxide solution, a KOH solution, a mixed liquid of fluorinated acid and nitric acid, or the like in the case of the single-crystal silicon, and wet etching is performed using a fluorinated acid etching liquid or the like in the case of the glass substrate. In addition, dry etching such as reactive ion etching (RIE) or plasma etching is performed.

Next, after the photoresist mask is all removed from the surface of the substrate 2, as illustrated in FIG. 3B, the undercoat 3 is bonded to the substrate 2 so that the surfaces thereof are brought into contact with each other (bonding step). In a state where the undercoat 3 is formed on the surface of the substrate 2 in this manner, the hollow portion 7 is formed between the substrate 2 and the undercoat 3. In this case, the depth of the concave portion 8 is equal to a depth of the hollow portion 7 (in other words, thickness of the void heat insulating layer 7), and hence the thickness of the heat insulating layer 7 is easily controlled. As a material of the undercoat 3, for example, glass or a resin is used.

Alternatively, in the case where the undercoat 3 made of thin glass is bonded to the substrate 2 made of glass, bonding is performed using heat fusion in which an adhesive layer is not used. A bonding process of the substrate 2 made of glass and the undercoat 3 made of thin glass is performed at a temperature equal to or higher than an annealing temperature to a temperature equal to or lower than a softening temperature of the substrate 2 made of glass and the undercoat 3 made of thin glass. Therefore, a shape of the substrate 2 and a shape of the undercoat 3 can be maintained with high accuracy, which ensures high reliability.

In this context, thin glass having a thickness of about 10 μm is difficult to be manufactured and handled, and is also costly. Thus, in place of bonding the above-mentioned thin glass directly to the substrate 2, thin glass having a thickness which allows easy manufacturing or handling thereof may be bonded to the substrate 2 to be processed so as to have a desired thickness by etching, polishing, or the like. In this case, extremely thin undercoat 3 is formed on one surface of the substrate 2 with ease and at a low cost.

Then, wet etching is performed using a fluorinated acid etching liquid or the like until the undercoat 3 has a desired thickness to be left. Then, due to a difference in etch rate, as illustrated in FIG. 3C, a concave-convex portion 11 having a sawtooth form in cross section (or waveform in cross section) is formed in the region on the surface of the undercoat 3, in which the heterogeneous phase 10 is formed.

Next, the heating resistors 4, the individual wires 5*b*, the common wire 5*a*, and the protective film 6 are sequentially formed on the undercoat 3 thus formed, thereby obtaining the thermal head 1 illustrated in FIG. 1. It should be noted that the heating resistors 4, the individual wires 5*b*, and the common wire 5*a* are formed in an appropriate order.

The heating resistors 4, the individual wires 5*b*, the common wire 5*a*, and the protective film 6 can be manufactured using a conventional manufacturing method therefor which is conventionally employed in a thermal head. Specifically, a thin film formation method such as sputtering, chemical vapor deposition (CVD), and vapor deposition is used to form a thin film made of a Ta-based or silicide-based heating resistor material on the insulating film, and the thin film made of the heating resistor material is molded using lift-off, etching, or the like, whereby a heating resistor having a desired shape is formed.

Similarly, on the undercoat 3, a film made of a wiring material such as Al, Al—Si, Au, Ag, Cu, and Pt is formed using sputtering, vapor deposition, or the like to form the film using lift-off or etching, or the wiring material is screen printed and baked thereafter, to thereby form the individual wires 5*b* and the common wire 5*a* which have the desired shape.

After the formation of the heating resistors 4, the individual wires 5*b*, and the common wire 5*a* as described above, a film made of a protective film material such as $SiO_2$, $Ta_2O_5$, SiAlON, $Si_3N_4$, or diamond-like carbon is formed on the undercoat 3 using sputtering, ion plating, CVD, or the like to form the protective film 6.

In the thus manufactured thermal head 1 according to this embodiment, the heterogeneous phase 10 which improves a mechanical strength is formed in a region (that is, region opposed to the respective concave portions 8 of the undercoat 3 (and boundary region thereof)) to which a bending stress is applied when the thermal head 1 is pressed against a thermal paper 63 (see FIG. 5) by a pressure mechanism 64 with a predetermined pressing force, with the result that the plate thickness of the undercoat 3 can be reduced when compared with those in the conventional cases (for example, can be made smaller than 10 μm).

Further, as illustrated in FIG. 2, the concave-convex portion 11 is formed on (extends to) the surface of the protective film 6 formed (laminated) on the undercoat 3, and thus surface roughness of the protective film 6 can be increased, whereby a pressing force applied to the thermal paper 63 can be locally increased. Accordingly, heat transfer efficiency can be improved.

Further, a contact area with the thermal paper 63 is reduced because of the concave-convex portion 11 formed on the surface of the protective film 6, with the result that a sticking phenomenon (phenomenon in which a part of a coupler or a developer melted during printing sticks and adheres, when energy is cut off, to the thermal head 1 so as to cause poor transportation) can be prevented (reduced).

Figure 4A:
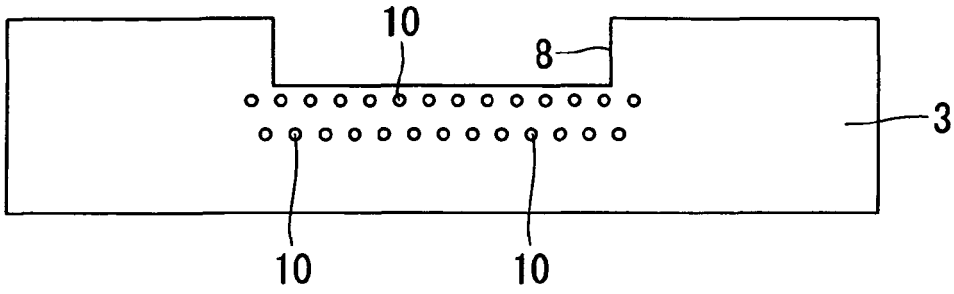
FIGS. 4A to 4C are process drawings for describing a manufacturing method for a thermal head serving as a heating resistor element component according to a second embodiment of the present invention, which are similar to FIG. 2.
Figure 4B:
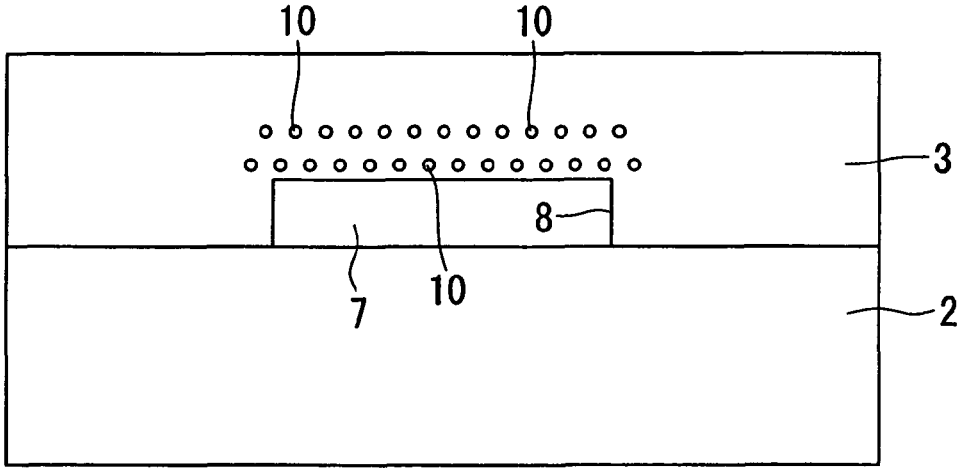
Figure 4C:
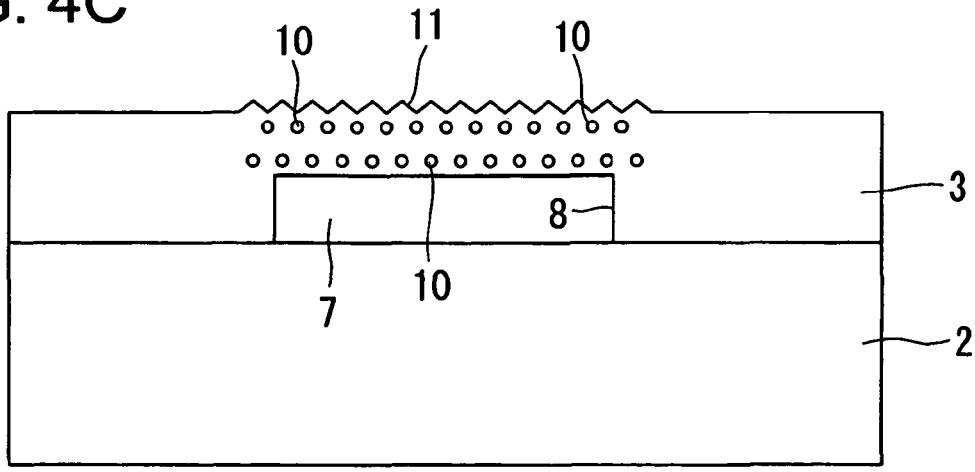

A thermal head according to a second embodiment of the present invention is described with reference to FIGS. 4A to 4C. FIGS. 4A to 4C are process drawings for describing a manufacturing method for the thermal head serving as a heating resistor element component according to this embodiment, which are similar to FIGS. 3A to 3C.

The thermal head according to this embodiment is different from the thermal head 1 according to the first embodiment described above in that the concave portion 8 is formed on the undercoat 3 but not formed on the substrate 2. Other components are the same as those of the thermal head 1 according to the first embodiment described above, and thus their descriptions are omitted here.

Next, with reference to FIG. 4A to 4C, the manufacturing method for the thermal head according to this embodiment is described.

First, as illustrated in FIG. 4A, the concave portion 8 which forms the hollow portion 7 is processed for each region on the surface (upper surface in FIG. 4A) of the undercoat 3 having a uniform thickness, in which the heating resistor 4 is formed.

Then, a femtosecond laser (ultra-short pulse laser having high focused intensity of $1\times10^{6}$ W to $1\times10^{8}$ W, ($1\times10^{-14}$ sec to $1\times10^{-12}$ sec)) is irradiated from the surface of the undercoat 3, and the heterogeneous phase (phase having physical properties different from those of a base material (in this case, undercoat 3)) 10 is formed in a region (and boundary region thereof) which is on the surface of the undercoat 3 and corresponds to the respective concave portions 8.

In this embodiment, an irradiation pitch is set to 0.5 μm to 20 μm, and the femtosecond laser is adjusted so that the heterogeneous phase 10 is formed at a depth of 1 μm to 30 μm from the surface of the undercoat 3.

Next, as illustrated in FIG. 4B, the undercoat 3 is bonded to the substrate 2 so that the surfaces thereof are brought into contact with each other (so that the surface of the undercoat 3 overlaps the surface of the substrate 2) (bonding step). In a state where the undercoat 3 is formed on the surface of the substrate 2 in this manner, the hollow portion 7 is formed between the substrate 2 and the undercoat 3. In this case, the depth of the concave portion 8 is equal to a depth of the hollow portion 7 (in other words, thickness of the void heat insulating layer 7), and hence the thickness of the void heat insulating layer 7 is easily controlled. As a material of the undercoat 3, for example, glass or a resin is used.

Then, wet etching is performed using a fluorinated acid etching liquid or the like until the undercoat 3 has a desired thickness to be left. Then, due to a difference in etch rate, as illustrated in FIG. 4C, the concave-convex portion 11 having a sawtooth form in cross section (or waveform in cross section) is formed in the region on the surface of the undercoat 3, in which the heterogeneous phase 10 is formed.

Next, the heating resistors 4, the individual wires 5*b*, the common wire 5*a*, and the protective film 6 are sequentially formed on the undercoat 3 thus formed, thereby obtaining the thermal head 1 illustrated in FIG. 1. It should be noted that the heating resistors 4, the individual wires 5*b*, and the common wire 5*a* are formed in an appropriate order.

After the formation of the heating resistors 4, the individual wires 5*b*, and the common wire 5*a* as described above, a film made of a protective film material such as $SiO_2$, $Ta_2O_5$, SiAlON, $Si_3N_4$, or diamond-like carbon is formed on the undercoat 3 using sputtering, ion plating, CVD, or the like to form the protective film 6.

The operation and effect of the thus manufactured thermal head according to this embodiment are the same as those of the first embodiment, and thus their descriptions are omitted here.

It should be noted that the thermal head according to the present invention is not limited to the thermal heads according to the embodiments described above, and can be modified, changed, and combined with one another, as necessary.

For example, in the first embodiment described above, the femtosecond laser is irradiated from the surface of the undercoat 3 to form the heterogeneous phase 10 on the surface of the undercoat 3, but the femtosecond laser may be irradiated from the surface of the undercoat 3 to form the heterogeneous phase 10 on the rear surface (lower surface in FIG. 3A) of the undercoat 3.

As a result, in the case where the undercoat 3 is superimposed on the substrate 2, a step of turning the undercoat 3 upside down is omitted, which simplifies the manufacturing step.

Further, more preferably, the concave portion 8 described in the second embodiment is processed through irradiation of a femtosecond laser.

As a result, a processing unit can be standardized in the step of processing the concave portion 8 and the step of processing the heterogeneous phase 10, leading to a reduction in working hours required for the manufacturing step.

Further, the example in which the concave portions 8 as many as the heating resistors 4 are formed is described in the embodiments described above, but the present invention is not limited thereto. The concave portions 8 may be formed in an arrangement direction of the heating resistors 4 to straddle the heating resistors 4. In other words, one concave portion 8 may be used.

According to the thermal head including the concave portions formed therein, the adjacent concave portions are made to be in communication with each other, and a part of a flowing path of heat (amount of heat) generated in the heating resistors 4 into the substrate 2 is cut off, whereby the heat (amount of heat) generated in the heating resistors 4 can be further prevented from flowing into the substrate 2. As a result, heating efficiency of the heating resistors 4 can be further increased, which leads to an additional reduction in power consumption.

Figure 5:
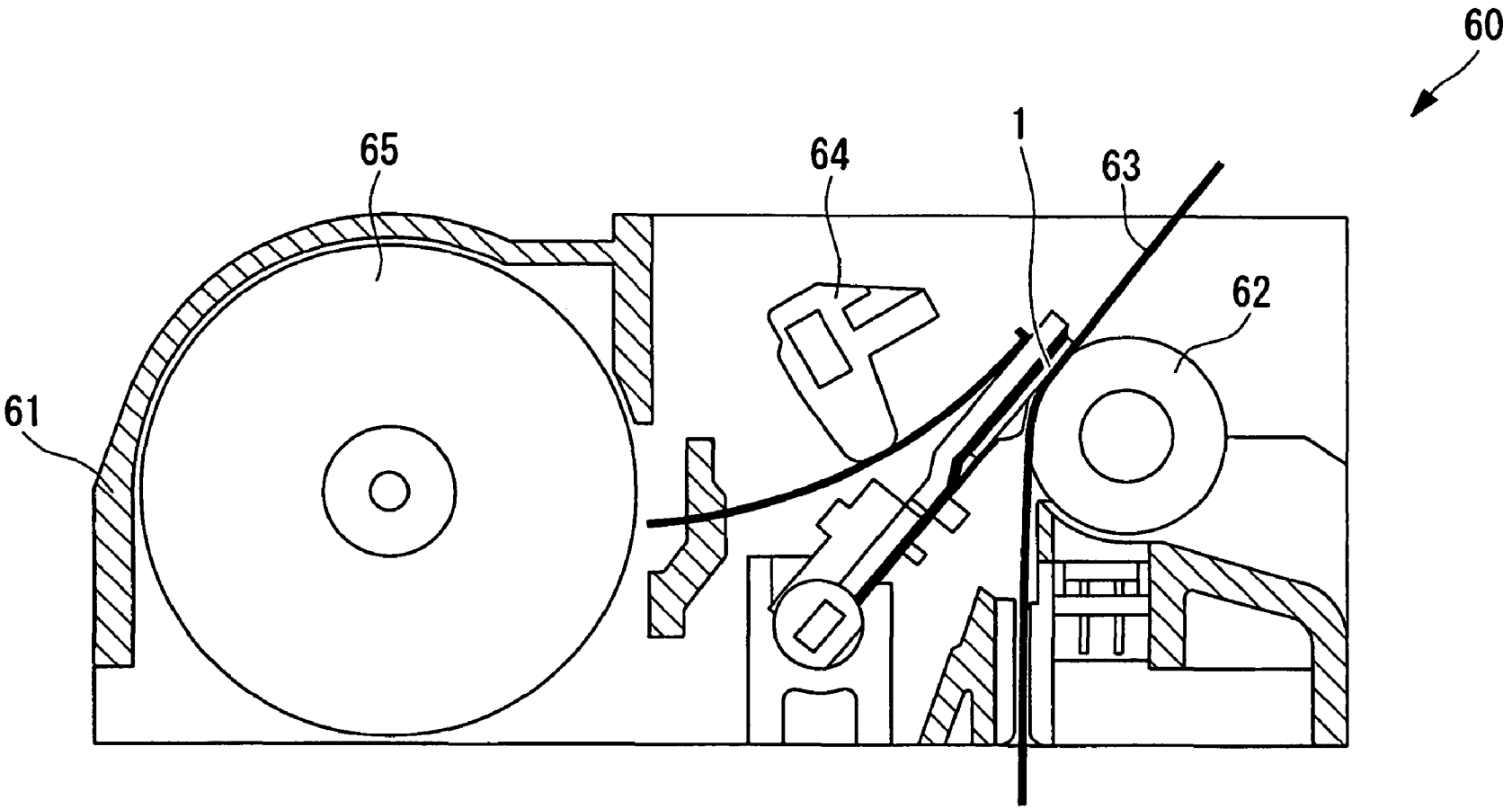
FIG. 5 is a longitudinal sectional view illustrating a thermal printer according to an embodiment of the present invention.

Next, a thermal printer 60 according to an embodiment of the present invention is described with reference FIG. 5.

The thermal printer 60 according to this embodiment includes a body frame 61 accommodating a platen roller 62 which is horizontally disposed and the thermal head (for example, thermal head 1 described in the first embodiment) according to the embodiments described above, which is pressed against the platen roller 62 with thermal paper 63 nipped therebetween. The thermal head 1 includes the plurality of heating resistors 4 which are arranged in a longitudinal direction of the platen roller 62, and is pressed against the thermal paper 63 with a predetermined pressing force by a pressure mechanism 64. In FIG. 5, reference numeral 65 denotes a sheet-feeding driving motor.

In the thermal printer 60 according to this embodiment, the heating efficiency of the thermal head 1 is high, and thus printing can be performed on the thermal paper 63 with less electric power. As a result, battery life can be extended.

It should be noted that in each of the embodiments, a description is given of the thermal head 1 and the thermal printer 60 which directly performs coloring through heating, but the present invention is not limited thereto. The present invention can be applied to a heating resistor element component other than the thermal head 1 and a printer other than the thermal printer 60.

For example, as the heating resistor element component, the present invention can be applied to a thermal inkjet head which discharges ink using heat, a valve-type inkjet head, or the like. In addition, the similar effects can be obtained in the case of electronic components including other film-like heating resistor element component, for example, a thermal erasure head which substantially has the same structure as a structure of the thermal head, a fixing heater such as a printer which requires thermal fixing, or a thin-film heating resistor element for an optical waveguide optical component.

In addition, regarding the printer, the present invention can be applied to a thermal transfer printer using sublimation-type or fusing-type transfer ribbon, a rewritable thermal printer capable of coloring and erasing of a printing medium, a thermal active adhesive-type label printer which exhibits adhesion through heating, or the like.

What is claimed is:

1. A heating resistor element component, comprising:

a supporting substrate having a concave portion formed in a surface of the supporting substrate;

a glass substrate disposed on the surface of the supporting substrate, at least a region of the glass substrate opposite to the concave portion of the support substrate having a heterogeneous phase structure with physical properties different from those of the material of the glass substrate such that an overall mechanical strength of the glass substrate is increased, the heterogeneous phase structure being formed by laser processing using a phemtosecond laser having a power intensity of $1\times10^6$ W to $1\times10^8$ W;

a plurality of heating resistors arranged at intervals on the glass substrate and having heating portions disposed opposite to the concave portion of the supporting substrate;

a common wire connected to one end of each of the plurality of heating resistors; and a plurality of individual wires each connected to another end of each of the plurality of heating resistors.

2. A thermal printer using a thermal head comprising the heating resistor element component according to claim 1.

3. A heating resistor element component according to claim 1; wherein the heterogeneous phase structure is formed in a position located 1 μm to 30 μm below from the surface of the glass substrate.

4. A heating resistor element component according to claim 1; wherein the supporting substrate comprises a single-crystal silicon substrate having a thickness in the range of about 300 μm to 1 mm.

5. A heating resistor element component according to claim 1; wherein the supporting substrate comprises a glass supporting substrate bonded to the glass substrate using heat fusion.

6. A heating resistor element component, comprising:

a supporting substrate;

a glass substrate disposed on a surface of the supporting substrate, the glass substrate having a concave portion formed in a surface of the glass substrate confronting the surface of the supporting substrate, at least a region of the glass substrate corresponding to the concave part having a heterogeneous phase structure with physical properties different from those of the material of the glass substrate such that an overall mechanical strength of the glass substrate is increased, the heterogeneous phase structure being formed by laser processing using a phemtosecond laser having a power intensity of $1\times10^6$ W to $1\times10^8$ W;

a plurality of heating resistors arranged at intervals on the glass substrate and having heating portions disposed opposite to the concave portion of the supporting substrate;

a common wire connected to one end of each of the plurality of heating resistors; and a plurality of individual wires each connected to another end of each of the plurality of heating resistors.

7. A thermal printer using a thermal head comprising the heating resistor element component according to claim 6.

8. A heating resistor element component according to claim 6; wherein the heterogeneous phase structure is formed in a position located 1 μm to 30 μm below from the surface of the glass substrate.

9. A heating resistor element component according to claim 6; wherein the supporting substrate comprises a single-crystal silicon substrate having a thickness in the range of about 300 μm to 1 mm.

10. A heating resistor element component according to claim 6; wherein the supporting substrate comprises a glass supporting substrate bonded to the glass substrate using heat fusion.

11. A manufacturing method for a heating resistor element component, comprising the steps of:

forming a concave portion on a surface of a supporting substrate;

processing a region on a surface of a glass substrate with a phemtosecond laser having a power intensity of $1\times10^6$ W to $1\times10^8$ W to form a heterogeneous phase structure with physical properties different from those of the material of the glass substrate such that an overall mechanical strength of the glass substrate is increased;

superimposing the glass substrate on the surface of the supporting substrate so that the region of the glass substrate formed with the heterogeneous phase is opposite to the concave portion of the supporting substrate; and bonding the supporting substrate and the glass substrate to one another.

12. A method according to claim 11; wherein the processing step further comprises adjusting the femtosecond laser so that the heterogeneous phase structure is formed in a position located 1 μm to 30 μm below from the surface of the glass substrate.

13. A method according to claim 11; wherein the supporting substrate comprises a glass supporting substrate; and wherein bonding step comprises bonding the glass supporting substrate and glass substrate to one another using heat fusion.

14. A manufacturing method for a heating resistor element component, comprising the steps of:

forming a concave portion on a surface of a glass substrate;

processing a region on a surface of a glass substrate corresponding to the concave portion with a phemtosecond laser having a power intensity of $1\times10^6$ W to $1\times10^8$ W to form a heterogeneous phase structure with physical properties different from those of the material of the glass substrate such that an overall mechanical strength of the glass substrate is increased;

superimposing the surface of the glass substrate on which the concave portion is formed on a surface of supporting substrate; and bonding the supporting substrate and the glass substrate to one another.

15. A method according to claim 14; wherein the processing step further comprises adjusting the femtosecond laser so that the heterogeneous phase structure is formed in a position located 1 μm to 30 μm below from the surface of the glass substrate.

16. A method according to claim 14; wherein the supporting substrate comprises a glass supporting substrate; and wherein bonding step comprises bonding the glass supporting substrate and glass substrate to one another using heat fusion.

* * * * *